US009462859B2

(12) United States Patent
Disinger

(10) Patent No.: US 9,462,859 B2
(45) Date of Patent: Oct. 11, 2016

(54) LIGHT EMITTING JEWELRY

(71) Applicant: John William Disinger, Santa Claus, IN (US)

(72) Inventor: John William Disinger, Santa Claus, IN (US)

( * ) Notice: Subject to any disclaimer, the term of this patent is extended or adjusted under 35 U.S.C. 154(b) by 0 days.

(21) Appl. No.: 14/487,969

(22) Filed: Sep. 16, 2014

(65) Prior Publication Data

US 2015/0075217 A1 Mar. 19, 2015

Related U.S. Application Data

(60) Provisional application No. 61/878,159, filed on Sep. 16, 2013.

(51) Int. Cl.

| | |
|---|---|
| ***A44C 15/00*** | (2006.01) |
| ***A44C 17/00*** | (2006.01) |
| *A44C 17/04* | (2006.01) |
| *A44C 9/00* | (2006.01) |

(52) U.S. Cl.

CPC ..... *A44C 15/0015* (2013.01); *A44C 9/00* (2013.01); *A44C 17/007* (2013.01); *A44C 17/04* (2013.01)

(58) Field of Classification Search

CPC .... A44C 17/00; A44C 17/001; A44C 17/02; A44C 17/007

USPC ..... 63/26, 32

See application file for complete search history.

(56) References Cited

U.S. PATENT DOCUMENTS

| | | | | |
|---|---|---|---|---|
| 1,064,152 | A * | 6/1913 | Meyer | A44C 17/02 63/15 |
| 1,392,604 | A | 10/1921 | Smith | |
| 1,812,058 | A | 6/1931 | Paul | |
| 4,942,744 | A | 7/1990 | Wei | |
| 5,323,300 | A | 6/1994 | McCrary | |
| 5,758,945 | A | 6/1998 | Lima | |
| 6,422,038 | B1 * | 7/2002 | Chin | A44C 17/02 63/26 |
| 6,928,834 | B2 | 8/2005 | Robertson | |
| 6,990,833 | B2 | 1/2006 | Smith | |
| 6,997,014 | B2 | 2/2006 | Starcke et al. | |
| 7,222,980 | B1 | 5/2007 | Pinciaro | |
| 7,526,928 | B1 * | 5/2009 | Kearnes | A44C 17/00 63/32 |
| D632,205 | S | 2/2011 | Mehta | |
| 8,769,987 | B2 | 7/2014 | Mehta | |
| 8,844,319 | B2 | 9/2014 | Weingarten | |
| 2003/0221452 | A1 * | 12/2003 | Morbidoni | A44C 17/02 63/26 |
| 2004/0083759 | A1 * | 5/2004 | Starcke | A44C 27/006 63/32 |
| 2005/0044890 | A1 * | 3/2005 | Lodholz | A44C 17/02 63/27 |
| 2007/0036921 | A1 * | 2/2007 | Twitchen | A44C 17/00 428/15 |
| 2008/0087042 | A1 * | 4/2008 | Heimann | A44C 17/02 63/26 |
| 2009/0038341 | A1 | 2/2009 | Zheng | |
| 2011/0030422 | A1 | 2/2011 | Kang | |
| 2011/0110201 | A1 | 5/2011 | Boularas | |
| 2012/0060557 | A1 * | 3/2012 | van Looveren | A44C 17/001 63/32 |
| 2015/0007610 | A1 * | 1/2015 | Greulich | A44C 17/003 63/32 |

FOREIGN PATENT DOCUMENTS

| | | | | |
|---|---|---|---|---|
| CN | 102754975 | A | 10/2012 | |
| GB | 182138 | A * | 9/1923 | A44C 17/007 |
| WO | 0069303 | A1 | 11/2000 | |
| WO | 2009121908 | A1 | 10/2009 | |

* cited by examiner

*Primary Examiner* — Emily Morgan

(74) *Attorney, Agent, or Firm* — Barnes & Thornburg LLP

(57) ABSTRACT

A light-emitting jewelry piece includes a gemstone, a head, and a mounting. The head is configured to interconnect the gemstone to the mounting. The mounting is arranged secure the light-emitting jewelry piece to a person or a personal adornment.

11 Claims, 7 Drawing Sheets

LIGHT EMITTING JEWELRY

PRIORITY CLAIM

This application claims priority under 35 U.S.C. §119(e) to U.S. Provisional Application Ser. No. 61/878,159, filed Sep. 16, 2013, which is expressly incorporated by reference herein.

BACKGROUND

The present disclosure relates to jewelry, and particularly to jewelry including a gemstone. More particularly, the present disclosure relates to jewelry including a gemstone configured to communicate light through the gemstone.

SUMMARY

According to the present disclosure, a light-emitting jewelry piece includes a gemstone. The gemstone may be a piece of material used to make an adornment such as, for example, a mineral, metal, rock, plastic, glass, colored gemstone, whether precious or non-precious, natural diamond, and lab-created diamond. In some embodiments, the light-emitting jewelry piece further includes a head. The head interconnects the gemstone to a mounting for securing the light-emitting jewelry piece to a person or a personal adornment.

In some embodiments, a light-emitting jewelry piece includes a gemstone and a light-emission system. The light-emission system includes a light-emitting shell configured to provide means for emitting light over time in response to receiving and storing light to cause visible light to be emitted through the gemstone. The light emitted through the gemstone may be viewed by a person when the light-emitting jewelry is in a dusk to dark environment.

The gemstone includes a crown, a girdle, a pavilion, and a culet. In some embodiments, the girdle has a relatively large thickness when compared to an ideal cut diamond. In some embodiments, a pavilion angle is defined between an outer surface of the pavilion and a bottom edge of the girdle and the pavilion angle is in a range of about 39 degrees and about 45 degrees. In some embodiments, the culet is mated with a portion of the light-emission system and the culet is oversized compared to an ideal cut diamond to increase a surface area of engagement between the culet and the light-emission system.

In another embodiment, a light-emitting jewelry piece includes a gemstone and a light-emission system that includes a light-emitting shell, a first light source, and a second light source. The first and second light sources are configured to provide means for emitting light over time to cause visible light to be emitted through the gemstone. The light is viewed by a person when the light-emitting jewelry is in a dusk to dark environment. In some embodiments, the light-emitting shell is made from a photo-luminescent material and the first and second light sources are self-luminous light sources such as, for example, tritium powered light sources.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is an exploded perspective view of a light-emitting jewelry piece in accordance with the present disclosure showing that the light-emitting jewelry piece includes, from top to bottom, a gemstone, a light-emission system arranged to receive the gemstone and discharge light through the gemstone, a head arranged to support the gemstone and the light-emission system, and a mount arranged to secure the light-emitting jewelry piece to a person or personal adornment;

Figure 9:
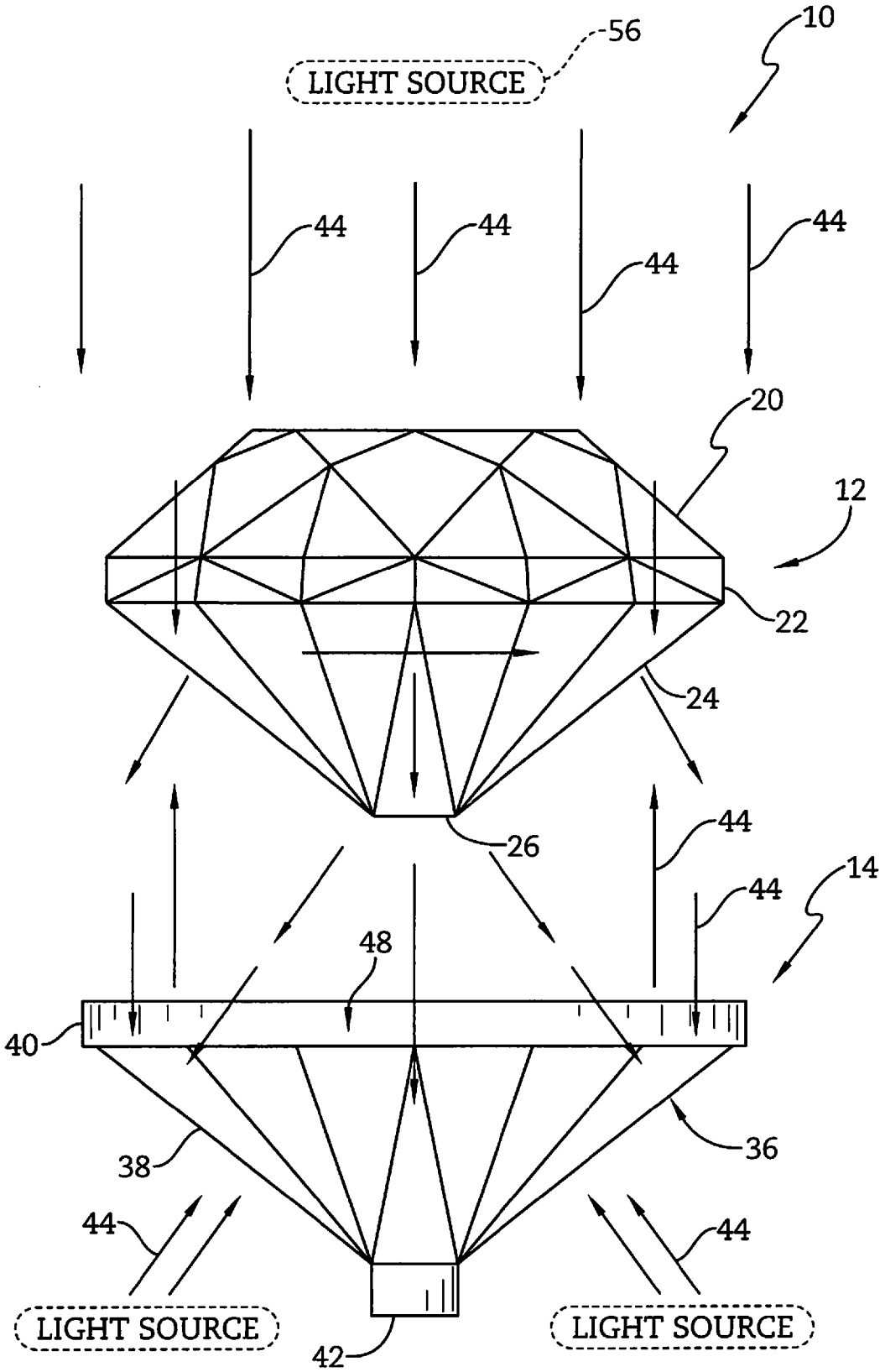
Figure 10:
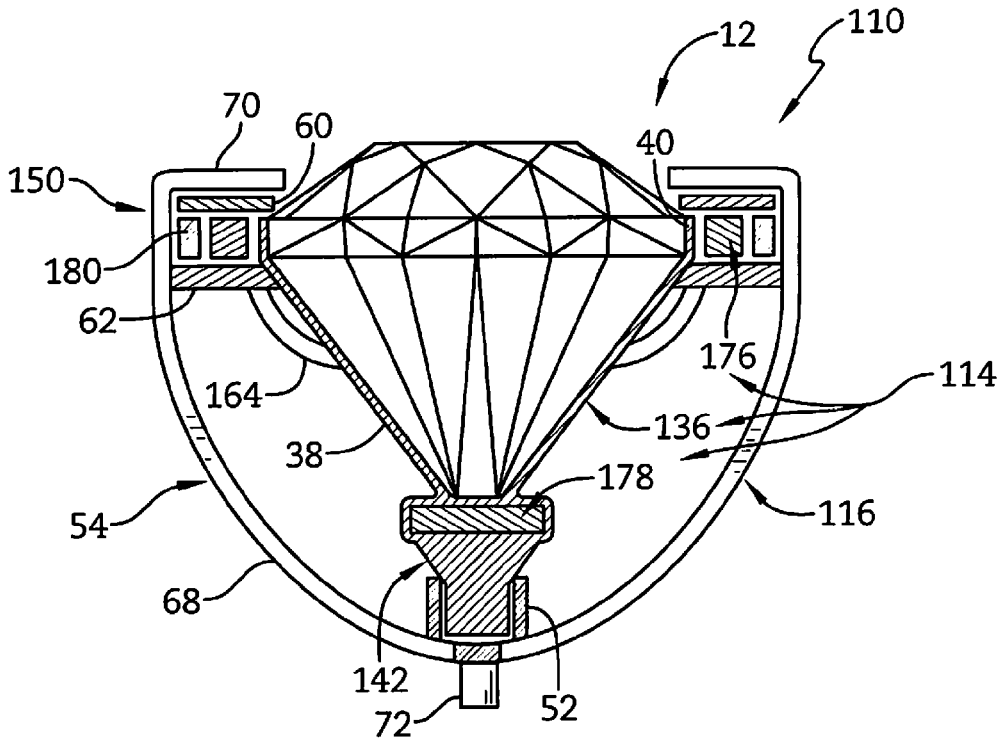
Figure 11:
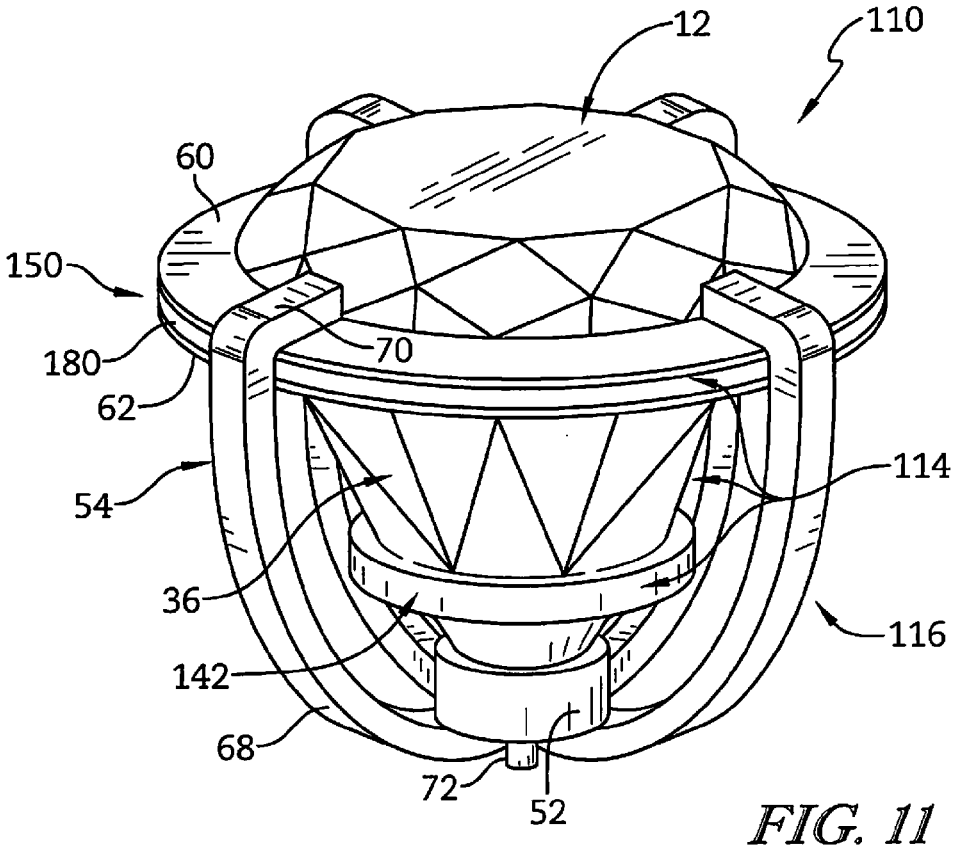
Figure 12:
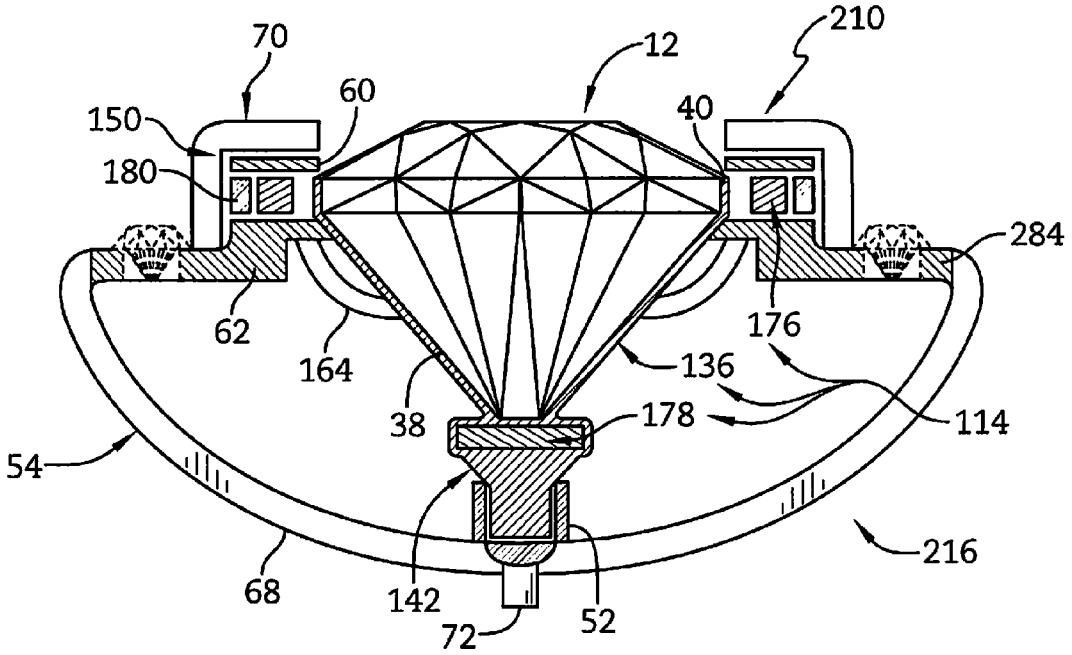
Figure 13:
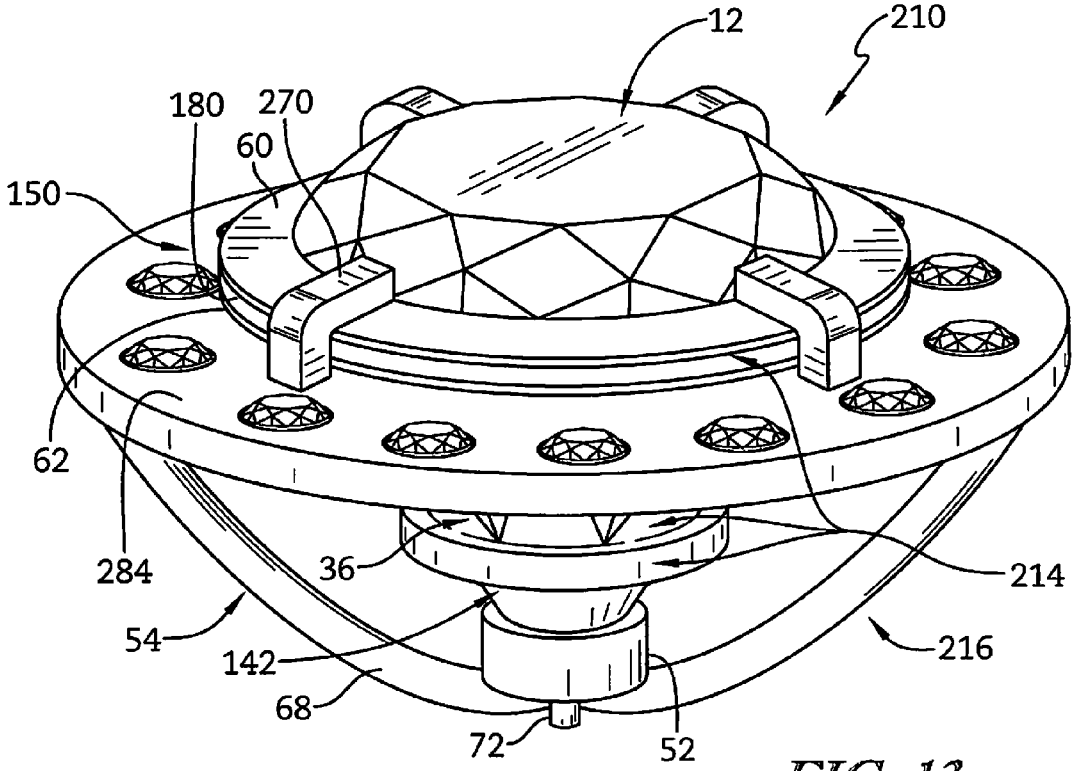

FIG. 9 is a diagrammatic view and elevation view showing the gemstone spaced apart from the light-emission system and suggesting how UV light or ambient light emitted from a light source (e.g., sun light or electrical lighting) located above the gemstone enters the gemstone through the crown and leaks out of the gemstone through the pavilion where the light is captured by the light-emission system and emitted back into the gemstone through the oversized culet and high-polished girdle over a period of time;

FIG. 10 is a sectional and diagrammatic view of another embodiment of a light-emitting jewelry piece in accordance with the present disclosure showing that the light-emitting jewelry piece includes, from top to bottom, a gemstone, a light-emission system arranged to receive the gemstone and discharge light through the gemstone, a head, and a mount, and further showing that the light-emission system includes a light-emitting shell arranged to receive the gemstone, a first light source arranged to form a ring around the gemstone, and a second light source positioned under the gemstone, and the first and second light sources provide light to illuminate the gemstone and to charge the light-emitting shell;

FIG. 11 is a perspective view of the light-emitting jewelry piece of FIG. 10;

FIG. 12 is a sectional and diagrammatic view of another embodiment of a light-emitting jewelry piece in accordance with the present disclosure showing that the light-emitting jewelry piece includes, from top to bottom, a gemstone, a light-emission system arranged to receive the gemstone and discharge light through the gemstone, a head including a halo-ring arranged around the gemstone, and a mount, and further showing that the light-emission system includes a light-emitting shell arranged to receive the gemstone, a first light source arranged to form a ring around the gemstone, and a second light source positioned under the gemstone, and the first and second light sources provide light to illuminate the gemstone and halo ring and to charge the light-emitting shell; and FIG. 13 is a perspective view of the light-emitting jewelry piece of FIG. 12.

DETAILED DESCRIPTION

Figure 1:
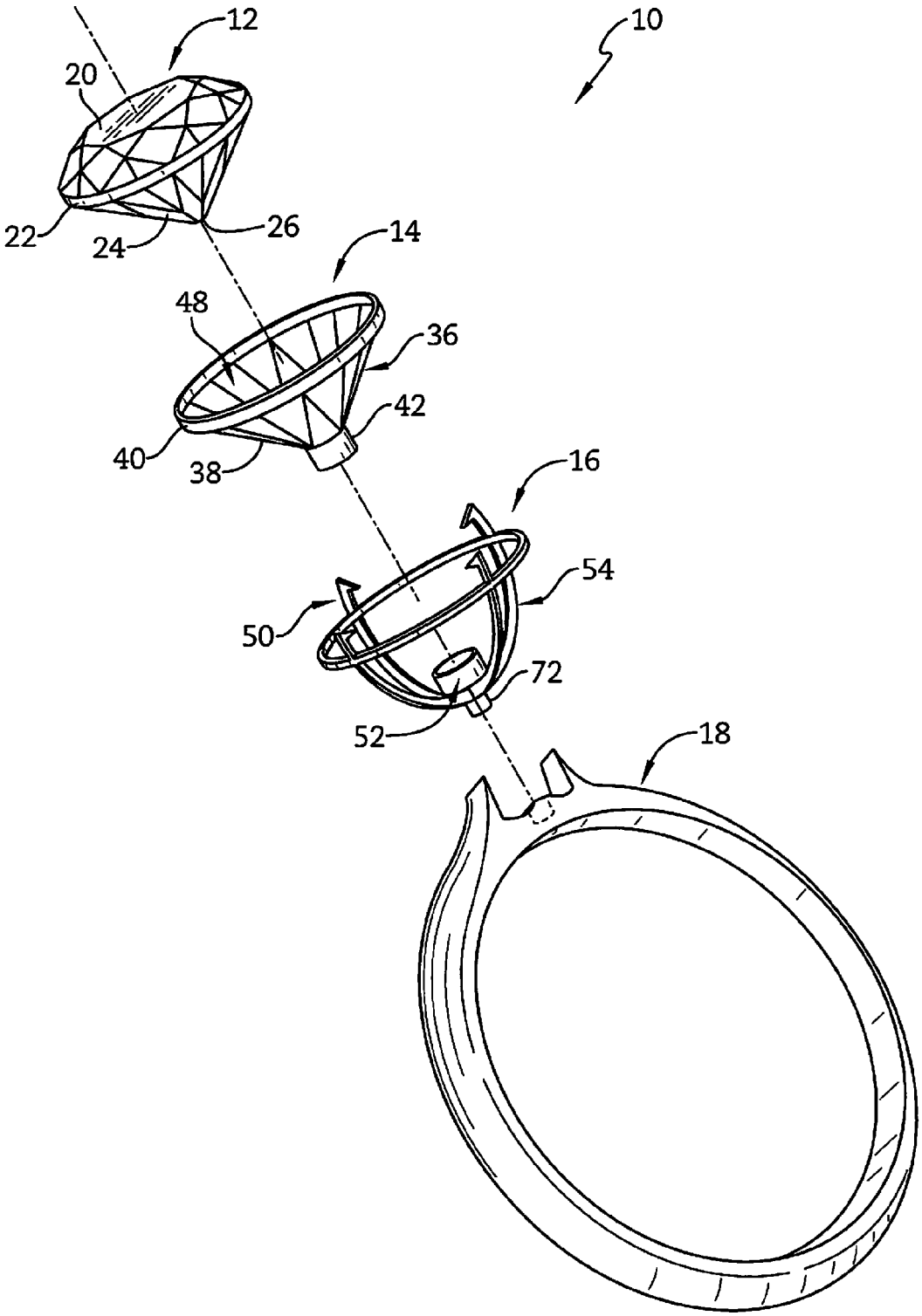

A light-emitting jewelry piece 10 in accordance with the present disclosure is shown in FIGS. 1-9. In one example, the light-emitting jewelry piece 10 is a ring as shown in FIG. 1. In another example, the light-emitting jewelry piece 10 is a pendant. Another light-emitting jewelry piece 110 in accordance with the present disclosure is shown in FIGS. 10 and 11. Another light-emitting jewelry piece 210 in accordance with the present disclosure is shown in FIGS. 11 and 12.

The light-emitting jewelry piece 10 includes a gemstone 12, a light-emission system 14, a head 16, and a mounting 18. The gemstone 12 is a piece of material used to make an adornment such as, for example, a mineral, metal, rock, plastic, glass, colored gemstone, whether precious or non-precious, natural diamond, and lab-created diamond. The light-emission system 14 is configured to provide means for emitting light over time in response to receiving and storing energy 44 (e.g., UV light or ambient light) to cause visible light to be emitted through the gemstone 12 and viewed by a person when the light-emitting jewelry 10 is in a dusk to dark environment. The head 16 interconnects the gemstone 12 to the mounting 18. The mounting 18 secures the light-emitting jewelry piece 10 to a person or a personal adornment.

Figure 2:
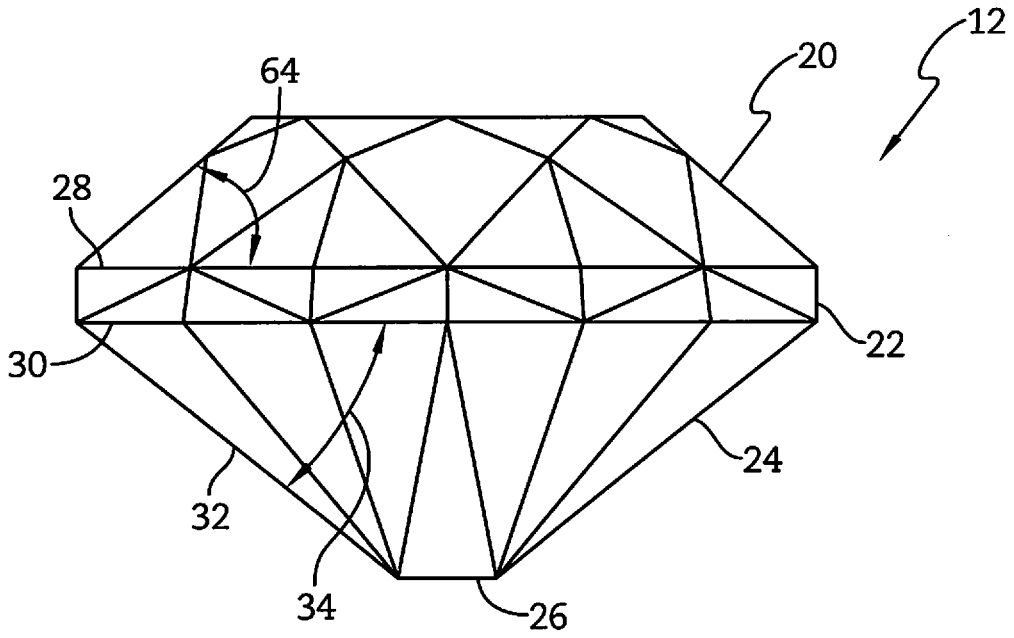
FIG. 2 is an elevation view of the gemstone of FIG. 1 showing that the gemstone includes, from top to bottom, a crown, a relatively thick girdle, a pavilion having a relatively small pavilion angle, and a relatively large open culet.

Illustratively, the gemstone 12 is a round-cut diamond. In the illustrative embodiment, the gemstone 12 is about one-half of a carat. The gemstone 12 includes a crown 20, a girdle 22, a pavilion 24, and a culet 26 as shown in FIGS. 1 and 2. The crown 20 is located in spaced-apart relation above the pavilion 24 to locate the girdle 22 therebetween. The pavilion 24 is located between the girdle 22 and the culet 26. The culet 26 is a generally flat face on a bottom of the gemstone 12.

The girdle 22 includes a top edge 28 and a bottom edge 30 spaced apart from the top edge 28 as shown in FIG. 2. In the illustrative embodiment, the girdle 22 has a diameter of about 5.2 millimeters. In the illustrative embodiment, the bottom edge 30 is spaced apart from the top edge 28 by a generally consistent distance around the circumference of the gemstone 12. In some embodiments, the bottom edge 30 is spaced apart from the top edge 28 by a first distance in primary portions of the girdle 22 and by a second distance in secondary portions of the girdle 22. Each primary portion is positioned circumferentially between a pair of secondary portions. The first distance is greater than the second distance.

In the example shown in FIG. 1, the girdle 22 has a relatively large thickness when compared to an ideal cut diamond such as American Standard cut or the Tolkowsky Brilliant cut. The relatively large thickness may be about 10 percent to about 15 percent larger than an ideal cut diamond. In embodiments that include primary and secondary portions, the primary portions and the secondary portions are about 10 percent to about 15 percent larger than the primary and secondary portions of an ideal cut diamond respectively. The girdle 22 is also highly polished. The relatively thick girdle 22 is configured to mate with a shoulder support 40 of the light-emission system 14. The girdle 22 has the relatively greater thickness to increase a surface area engagement between the gemstone 12 and the shoulder support 40 of the light-emission system 14.

The crown 20 extends from the girdle 22 away from the pavilion 24 as shown in FIG. 2. An outer surface of the crown 20 and the top edge 28 of the girdle 22 define a crown angle 64 as shown in FIG. 2. In one example, the crown angle 64 is in a range of about 39 degrees to about 46 degrees, about 39 degrees to about 45 degrees, or about 39 degrees to about 44 degrees. In another example, the crown angle 64 is in a range of about 39.9 degrees to about 46 degrees, about 40 degrees to about 46 degrees, about 41 degrees to about 46 degrees, about 42 degrees to about 46 degrees, about 43 degrees to about 46 degrees, about 44 degrees to about 46 degrees, and about 45 degrees to about 46 degrees. In still yet another example, the crown angle 64 is about 40.2 degrees. In still yet another example, the crown angle 64 is about 40.22 degrees.

The pavilion 24 extends between and interconnects the girdle 22 and the culet 26 as shown in FIG. 2. The pavilion 24 includes a plurality of outer surfaces 32 that extend between and interconnect the girdle 22 and the culet 26. A pavilion angle 34 is defined between each outer surface 32 of the pavilion 24 and the bottom edge 30 of the girdle 22 as shown in FIG. 1. In one example, the pavilion angle 34 is in a range of about 39 degrees to about 45 degrees, about 40 degrees to about 45 degrees, about 41 degrees to about 45 degrees, about 41.5 degrees to about 45 degrees, about 42 degrees to about 45 degrees, and about 43 degrees to about 45 degrees.

In another example, the pavilion angle 34 is in a range of about 39 degrees and about 44 degrees, about 39 degrees to about 43 degrees, about 39 degrees to about 42 degrees, about 39 degrees to about 41.5 degrees, and about 39 degrees to about 40 degrees. In still yet another example, the pavilion angle 34 is about 41.5 degrees.

The culet 26 is, for example, oversized when compared to an ideal cut diamond such as the American Standard cut or the Tolkowsky Brilliant cut. The culet 26 may be about 10 percent to about 15 percent larger than a culet of an ideal cut diamond. In the illustrative embodiment, the culet 26 is about 13 percent larger than a culet of an ideal cut diamond. The culet 26 may also be highly polished. In the illustrative embodiment, the culet 26 has a diameter of about 0.95 millimeters. The relatively oversized culet 26 is configured to mate with a culet cover 42 of the light-emission system 14. The culet 26 is relatively oversized to increase a surface area engagement between the gemstone 12 and the culet cover 42 of the light-emission system 14 for greater light absorption from the light-emission system 14 into the gemstone 12.

The light-emission system 14 emits light over a period of time to illuminate the gemstone 12 as shown in FIG. 9. In one example, the light-emission system 14 may emit a green light. In another example, the light-emission system 14 may emit a blue light. In still yet another example, the light-emission system 14 may emit any other suitable color of light. In other embodiments, the light-emission system 14 emits a plurality of colors of light.

Figure 3:
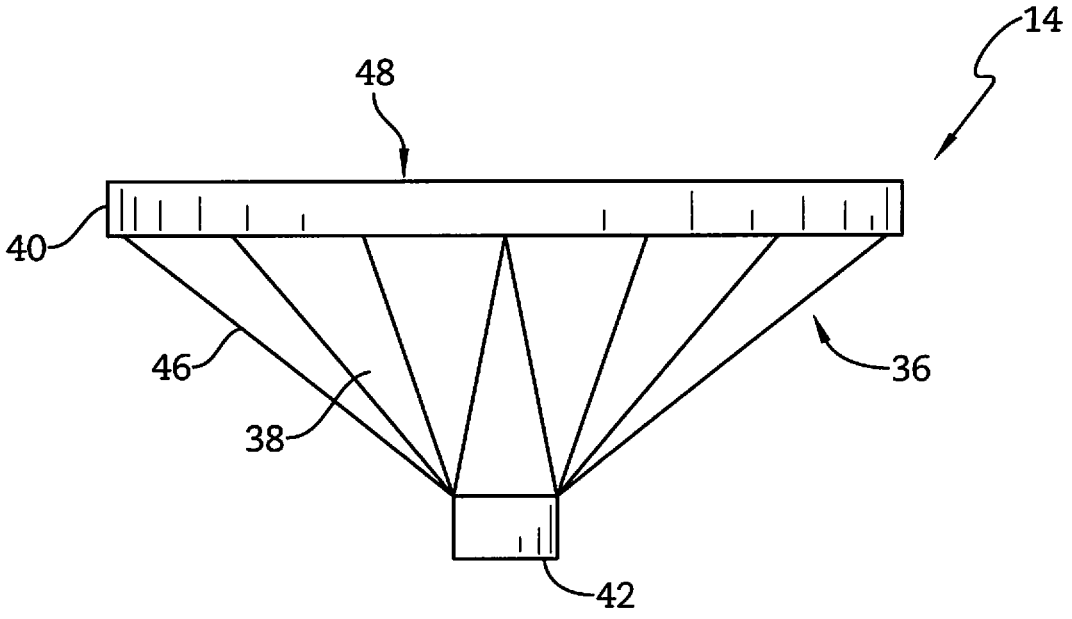
FIG. 3 is an elevation view of the light-emission system of FIG. 1 showing that the light-emission system includes a light-emitting shell arranged around the gemstone and configured to receive Ultra-Violet (UV) light or ambient light through the gemstone as suggested in FIG. 9 and store the UV light or ambient light for discharge through the gemstone over a period of time.

The light-emission system 14 is a light-emitting shell 36 in the illustrative embodiment as shown in FIG. 3. The light-emitting shell 36 emits visible light through the gemstone 12 to illuminate the gemstone 12 in response to receiving and storing energy 44 (e.g., UV light or ambient light). As such, the gemstone 12 is illuminated in dark environments by the light-emitting shell 36 until the stored energy 44 is depleted.

Illustratively, the light-emitting shell 36 is made from a photo-luminescent material. The light-emitting shell 36 may be rotocast or injection molded from the photo-luminescent material. In one example, the photo-luminescent material includes phosphorous material and poly-vinyl chloride. In another example, the photo-luminescent material includes phosphorous material and an acrylic material. In another example, the photo-luminescent material may include a phosphorous material, poly-vinyl chloride, an acrylic material, mixtures thereof, or any other suitable alternative. In the illustrative embodiment, the light-emitting shell 36 has a thickness of about 0.5 millimeters.

Figure 8:
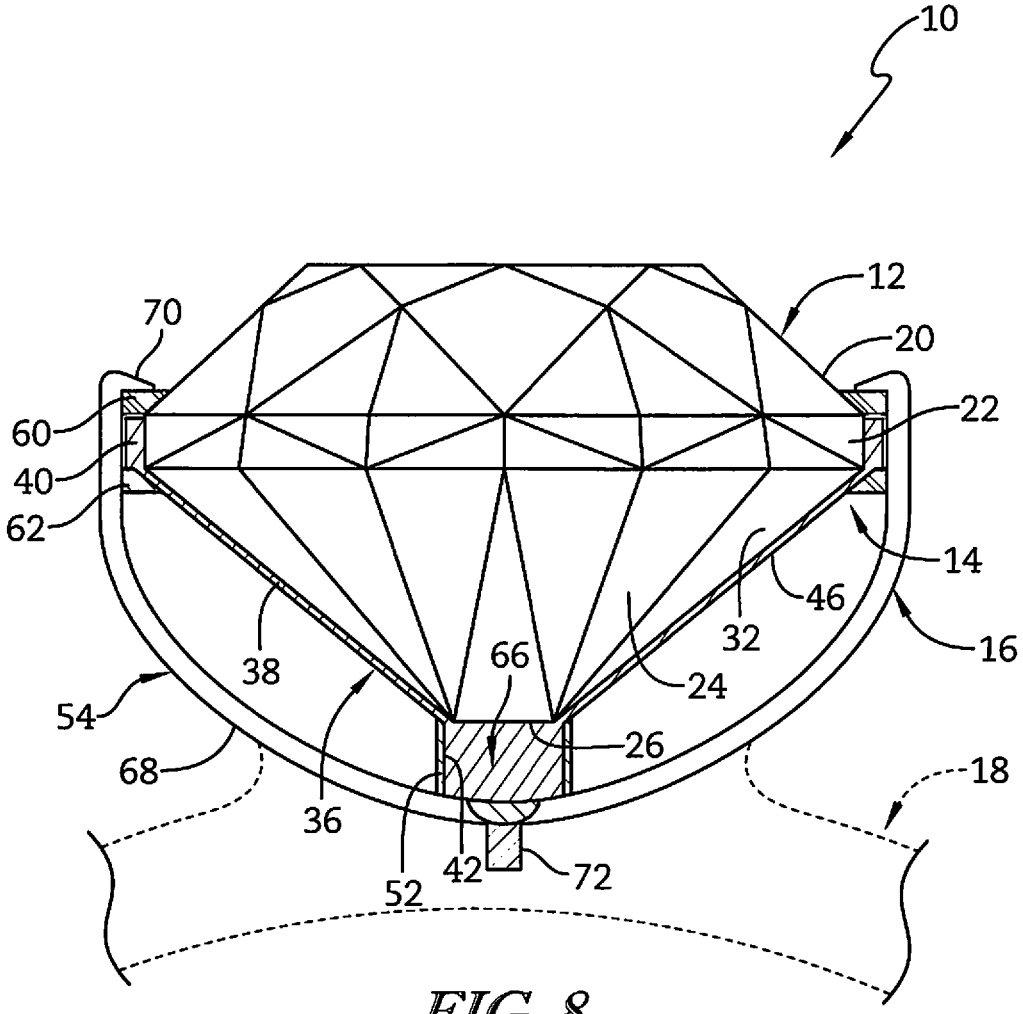
FIG. 8 is a sectional and diagrammatic view of the light-emitting jewelry piece of FIG. 1 showing that the gemstone is received in the light-emission system, the gem retainer of the head blocks the gemstone and light-emission system from moving through a top of the head, and the culet retainer blocks the gemstone and light-emission system from moving through a bottom of the head.

The light-emitting shell 36 is coupled to the head 16 in a fixed position as suggested in FIG. 8. The light-emitting shell 36 is configured to couple to the gemstone 12 in such a way as to minimize space between the gemstone 12 and the light-emitting shell 36 so that ingress of debris such as, for example, moisture, dirt, or condensation build up between the gemstone 12 and the light-emitting shell 36 is minimized.

Space between the gemstone 12 and the light-emitting shell 36 may be minimized through one or more manufacturing techniques. In one example, the light-emitting shell 36 is injection molded. In this example, the gemstone 12 is coupled to a portion of the mold using releasable sealant. During injection molding, molten plastics materials flow around the gemstone 12 into the mold chamber formed between the gemstone 12 and the mold. As a result, space between the gemstone 12 and the light-emitting shell 36 is minimized and the exact angle of the gemstone 12 in relation to the light-emitting shell 36 is provided. The gemstone 12 may be removed from the mold using a release pin which pushes the gemstone 12 away from the mold after molding. In addition, a gasket may be located between the girdle 22 of the gemstone 12 and the mold to minimize flashing of plastic material around the crown 20 of the gemstone 12.

The light-emitting shell 36 includes a body 38, the shoulder support 40, and the culet cover 42 as shown in FIG. 3. The body 38 engages the pavilion 24 to absorb and emit light through the gemstone 12. The shoulder support 40 engages the girdle 22 and couples the girdle 22 with the head 16. The culet cover 42 engages the culet 26 and couples the gemstone 12 with the head 16.

The body 38 is formed from a plurality of sidewalls 46. The sidewalls 46 are about parallel with the outer surfaces 32 included in the pavilion 24 of the gemstone 12. The sidewalls 46 engage with and mate with the pavilion 24 of the gemstone 12. Illustratively, the sidewalls 46 have a thickness of about 0.5 millimeters.

The plurality of sidewalls 46 cooperate to form a gemstone-receiver aperture 48 that extends into the light-emitting shell 36. The gemstone 12 is received in the gemstone-receiver aperture 48 to cause the sidewalls 46 of the body 38 to engage the outer surfaces 32 of the pavilion 24. In the illustrative embodiment, a sealant is located between the gemstone 12 and the body 38 to couple together the gemstone 12 and the body 38. The sealant blocks debris from entering the gemstone-receiver aperture 48 between the gemstone 12 and the body 38.

The shoulder support 40 extends radially outward from the body 38 away from the gemstone 12 as shown in FIG. 3. The shoulder support 40 extends around the body 38 circumferentially. The shoulder support 40 engages the girdle 22 of the gemstone 12 to couple the light-emitting shell 36 with the gemstone 12. In the illustrative embodiment, the shoulder support 40 has a thickness that is about equal to the thickness of the girdle 22. As such, the shoulder support 40 extends upwardly away from the body 38 to the top edge 28 of the girdle 22. In other embodiments, the shoulder support 40 has a thickness that is less than the thickness of the girdle 22. As a result, the shoulder support 40 may have an inverted L-shape.

The culet cover 42 extends downwardly from the body 38 away from the gemstone 12 as shown in FIG. 3. The culet cover 42 is positioned between the head 16 and the culet 26 to support the gemstone 12. The culet cover 42 is received in a space 66 formed in the head 16 to block movement of the light-emitting shell 36 away from the head 16. If the light-emitting jewelry piece 10 collides with a hard surface, the culet cover 42 blocks the head 16 from striking the culet 26 directly.

Figure 4:
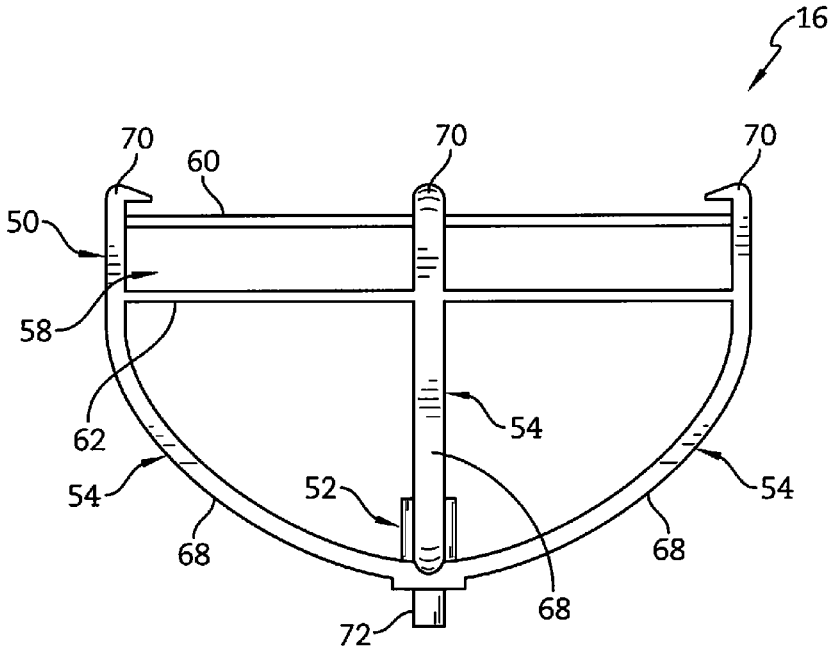
FIG. 4 is an elevation view of the head configured to receive the gemstone and the light-emission system of FIG. 1 therein and showing that the head includes a gem retainer arranged to support the girdle of the gemstone, a culet retainer arranged to support the culet of the gemstone, and a plurality of prongs that extend between and interconnect the gem retainer and the culet support.

The head 16 includes a gem retainer 50, a culet support 52, and a plurality of prongs 54 as shown in FIG. 4. The gem retainer 50 mates with the girdle 22 of the gemstone 12 and the shoulder support 40 of the light-emitting shell 36 to retain the light-emitting shell 36 between the gemstone 12 and the head 16. The culet support 52 is located in spaced-apart relation to the gem retainer 50 and mates with the culet 26 of the gemstone 12 and retains the culet cover 42 of the light-emitting shell 36 between the gemstone 12 and the head 16 as suggested in FIG. 4. The prongs 54 extend between and interconnect the gem retainer 50 and the culet support 52.

The gem retainer 50 is configured to receive the shoulder support 40 of the light-emitting shell 36 therein to retain the light-emission system 14 in place relative to the head 16 as suggested in FIG. 8. In another example, the head 16 is a peg style head that may be mated with any associated mounting 18 that accepts a peg head 72. As shown in FIG. 8, the gem retainer 50 is formed to include a female insert space 58 into which the shoulder support 40 of the light-emitting shell 36 is arranged to extend. That portion of the light-emitting shell 36 and the gemstone 12 may be coupled to the gem retainer 50 using watch crystal sealant, G.S. crystal sealant, or the like located in the female insert space 58.

In the illustrative embodiment, the gem retainer 50 includes an upper illusion plate 60 and a lower plate 62 as shown in FIG. 8. In some embodiments, the gem retainer 50 further includes a plurality of fold-up bars as shown in FIGS. 10-13. The illusion plate 60 and the lower plate 62 retain the gemstone 12 and light-emitting shell 36 in the head 16. In the illustrative embodiment, the illusion plate 60 and the lower plate 62 are ring shaped. The illusion plate 60 may be transparent.

The illusion plate 60, the lower plate 62, and the prongs 54 cooperate to form the female insert space 58 that receives the shoulder support 40 as shown in FIG. 8. The illusion plate 60 extends radially inward away from the prongs 54. The illusion plate 60 engages the crown 20 of the gemstone 12. The lower plate 62 extends radially inward away from the prongs 54. The lower plate 62 engages the pavilion 24 of the gemstone 12.

The culet support 52 receives the culet cover 42 of the light-emitting shell 36 as shown in FIG. 8. The culet support 52 extends upwardly away from the prongs 54 toward the gemstone 12. Illustratively, the culet support 52 has a U-shaped cross-section formed to include the space 66 into which the culet cover 42 of the light-emitting shell 36 extends. The culet cover 42 of the light-emitting shell 36 may be coupled to the head 16 using G.S. crystal sealant or the like.

The prongs 54 extend between and interconnect the gem retainer 50 and the culet support 52 as shown in FIG. 8. The prongs 54 support and locate the gem retainer 50 and the culet support 52. In the illustrative embodiment, the prongs 54 are coupled with the mounting 18 to couple the head 16 with the mounting 18.

Figure 5:
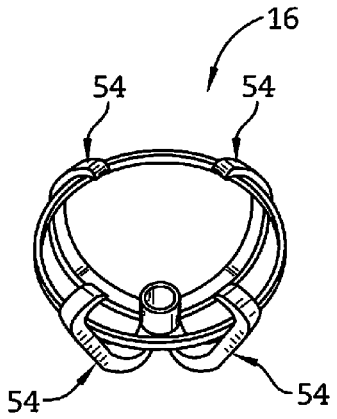
FIGS. 5-7 are a series of views showing various arrangements of the plurality of prongs (four, six, and eight) that may be included in the head.
Figure 6:
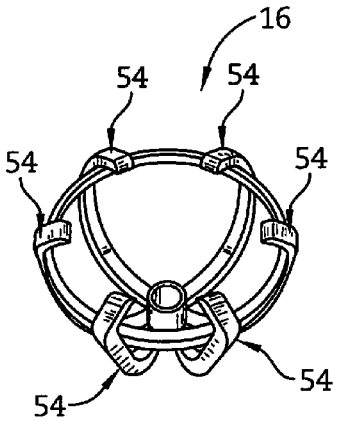
Figure 7:
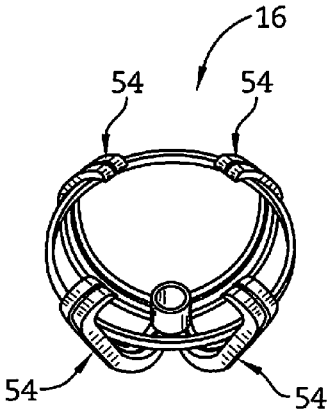

The head 16 may include, for example, four, six, or eight prongs 54 as shown in FIGS. 5-7. In one example, each prong 54 is spaced apart from every other prong 54 about an equal distance. The prongs 54 are configured to provide a gallery in which about 75 percent of the gallery is open so that light from additional light sources may enter the light-emission system 14 through the pavilion 24 as suggested in FIG. 9.

Each prong 54 includes a lower-prong support 68 and an upper prong tip 70 as shown in FIG. 4. Each of the lower-prong supports 68 are coupled together with the culet support 52. The upper prong tips 70 engage the gemstone 12 and the illusion plate 60 to block movement of the gemstone 12 and illusion plate 60. The lower plate 62 is coupled with the lower-prong support 68.

In operation, the light-emitting shell 36 and the gemstone 12 cooperate to capture light from an upper light source 56 as shown FIG. 9. The gemstone 12 is cut so that light transmitted through the crown 20 is communicated through the girdle 22, the pavilion 24, and the culet 26 to the light-emitting shell 36. As light 44 or other radiation enters the gemstone 12, some light 44 is communicated to the light-emitting shell 36 to charge the light-emitting shell 36. Light or radiation may also charge the light-emission system 14 by moving between the lower-prong support 68 of the prongs 54 as shown in FIG. 9 and through the pavilion 24 to the light-emission system 14.

The light 44 continuously charges the light-emitting shell 36. The light-emitting shell 36 continuously emits a portion of the stored light 44. The light-emitting shell 36 visually emits the stored light 44 through the gemstone's pavilion 24, girdle 22, and culet 26 and out of the crown 20 over time. As such, the gemstone 12 is illuminated by the light-emitting shell 36. Once ambient light decreases, such as after sun down or in a darkened room, the visually emitted light 44 may become more apparent to an observer.

Another light-emitting jewelry piece 110 in accordance with the present disclosure is shown in FIGS. 10 and 11. The light-emitting jewelry piece 110 includes the gemstone 12, a light-emission system 114, a head 116, and the mounting 18. The gemstone 12 is a piece of material used to make an adornment such as, for example, a mineral, metal, rock, plastic, glass, colored gemstone, whether precious or non-precious, natural diamond, and lab-created diamond. The light-emission system 114 is configured to provide means for emitting light over time to cause visible light to be emitted through the gemstone 12 and to be viewed by a person when the light-emitting jewelry 10 is in a dusk to dark environment. The head 116 interconnects the gemstone 12 to the mounting 18. The mounting 18 secures the light-emitting jewelry piece 110 to a person or a personal adornment.

Illustratively, the gemstone 12 is a round-cut diamond. The gemstone 12 includes the crown 20, the girdle 22, the pavilion 24, and the culet 26 as shown in FIGS. 10 and 11.

The light-emission system 114 emits light over a period of time to illuminate the gemstone 12 as shown in FIG. 10. In one example, the light-emission system 114 may emit a green light. In another example, the light-emission system 114 may emit a blue light. In still yet another example, the light-emission system 114 may emit any other suitable color of light. In other embodiments, the light-emission system 114 emits a plurality of colors of light.

The light-emission system 114 includes a light-emitting shell 136, a first light source 176, and a second light source 178 as shown in FIG. 10. The light-emitting shell 136 emits visible light through the gemstone 12 to illuminate the gemstone 12 in response to receiving and storing energy 44 (e.g., UV light or ambient light). As such, the gemstone 12 is illuminated in dark environments by the light-emitting shell 136 until the stored energy 44 is depleted. The first and second light sources 176, 178 emit visible light through the through the light-emitting shell 136 and the gemstone 12. The first and second light sources 176, 178 are, for example, self-luminous light sources.

Illustratively, the light-emitting shell 136 is made from the photo-luminescent material. The light-emitting shell 136 may be rotocast or injection molded from the photo-luminescent material. In one example, the photo-luminescent material includes phosphorous material and poly-vinyl chloride. In another example, the photo-luminescent material includes phosphorous material and an acrylic material. In another example, the photo-luminescent material may include a phosphorous material, poly-vinyl chloride, an acrylic material, mixtures thereof, or any other suitable alternative. In the illustrative embodiment, the light-emitting shell 136 has a thickness of about 0.5 millimeters.

The light-emitting shell 136 is coupled to the head 116 in a fixed position as suggested in FIG. 10. The light-emitting shell 136 is configured to couple to the gemstone 12 in such a way as to minimize space between the gemstone 12 and the light-emitting shell 136 so that ingress of debris such as, for example, moisture, dirt, or condensation build up between the gemstone 12 and the light-emitting shell 136 is minimized.

The light-emitting shell 136 includes the body 38, the shoulder support 40, and the culet cover 142 as shown in FIG. 10. The body 38 engages the pavilion 24 to absorb and emit light through the gemstone 12. The shoulder support 40 engages the girdle 22 and coupled the girdle 22 with the head 116. The culet cover 142 engages the culet 26 and couples the gemstone 12 with the head 116.

The culet cover 142 extends downwardly from the body 38 away from the gemstone 12 as shown in FIG. 10. The culet cover 142 extends around the second light source 178. The culet cover 142 is positioned between the head 116 and the culet 26 to support the gemstone 12. The culet cover 142 is received in a female insert space 58 formed in the head 116 to block movement of the light-emitting shell 136 away from the head 116. If the light-emitting jewelry piece 10 collides with a hard surface, the culet cover 142 blocks the head 116 from striking the culet 26 directly.

In the illustrative embodiment, the first and second light sources 176, 178 are powered through radioluminescence. In the illustrative embodiment, the first and second light sources 176, 178 are powered by tritium-illumination.

The first light source 176 extends around the shoulder support 40 as shown in FIG. 10. In the illustrative embodiment, the first light source 176 is a single ring. The first light source 176 is positioned in the female insert space 58 between the illusion plate 60 and the lower plate 62. A band 180 extends around the first light source 176 to minimize damage to the first light source 176. The band 180 is transparent to allow the light produced from the first light source 176 to be observed from outside of the head 116.

The second light source 178 is positioned in the culet cover 142 as shown in FIG. 10. In the illustrative embodiment, the second light source 178 is a rod. The second light source 178 emits light to illuminate the head 116 and the gemstone 12. In some embodiments, the second light source 178 is formed in the culet cover 142 as part of the molding process of light-emitting shell 136. In other embodiments, the second light source 178 is positioned in the culet cover 142 through an aperture formed in the culet cover 142.

The head 116 includes a gem retainer 150, the culet support 52, and the plurality of prongs 54 as shown in FIG. 10. The gem retainer 150 mates with the girdle 22 of the gemstone 12 and the shoulder support 40 of the light-emitting shell 136 to retain the light-emitting shell 136 between the gemstone 12 and the head 116. The culet support 52 is located in spaced-apart relation to the gem retainer 150 and mates with the culet 26 of the gemstone 12 and retains the culet cover 142 of the light-emitting shell 136 between the gemstone 12 and the head 116 as suggested in FIG. 10. The prongs 54 extend between and interconnect the gem retainer 150 and the culet support 52.

The gem retainer 150 is configured to receive the shoulder support 40 of the light-emitting shell 136 therein to retain the light-emission system 114 in place relative to the head 116 as suggested in FIGS. 10 and 11. The gem retainer 150 includes the upper illusion plate 60, the lower plate 62, and a plurality of fold-up bars 164 as shown in FIG. 10.

The fold-up bars 164 are coupled to the lower plate 62 and extend radially inward toward the light-emitting shell 136 as shown in FIG. 10. The fold-up bars 164 engage the light-emitting shell 136 to support the light-emitting shell 136 and the gemstone 12. In the illustrative embodiment, the gem retainer 150 includes four fold-up bars 164.

Another light-emitting jewelry piece 210 in accordance with the present disclosure is shown in FIGS. 12 and 13. The light-emitting jewelry piece 210 includes the gemstone 12, the light-emission system 114, a head 216, and the mounting 18. The gemstone 12 is a piece of material used to make an adornment such as, for example, a mineral, metal, rock, plastic, glass, colored gemstone, whether precious or non-precious, natural diamond, and lab-created diamond. The light-emission system 114 is configured to provide means for emitting light over time to cause visible light to be emitted through the gemstone 12 and to be viewed by a person when the light-emitting jewelry 10 is in a dusk to dark environment. The head 216 interconnects the gemstone 12 to the mounting 18. The mounting 18 secures the light-emitting jewelry piece 210 to a person or a personal adornment.

Illustratively, the gemstone 12 is a round-cut diamond. The gemstone 12 includes the crown 20, the girdle 22, the pavilion 24, and the culet 26 as shown in FIGS. 12 and 13.

The light-emission system 114 emits light over a period of time to illuminate the gemstone 12 as shown in FIG. 12. In one example, the light-emission system 114 may emit a green light. In another example, the light-emission system 114 may emit a blue light. In still yet another example, the light-emission system 114 may emit any other suitable color of light. In other embodiments, the light-emission system 114 emits a plurality of colors of light.

The light-emission system 114 includes the light-emitting shell 136, the first light source 176, and the second light source 178 as shown in FIG. 12. The light-emitting shell 136 emits visible light through the gemstone 12 to illuminate the gemstone 12 in response to receiving and storing energy 44 (e.g., UV light or ambient light). As such, the gemstone 12 is illuminated in dark environments by the light-emitting shell 136 until the stored energy 44 is depleted. The first and second light sources 176, 178 emit visible light through the through the light-emitting shell 136 and the gemstone 12. The first and second light sources 176, 178 are self-luminous light sources.

The head 216 includes the gem retainer 150, the culet support 52, and a plurality of prongs 254 as shown in FIG. 12. The gem retainer 150 mates with the girdle 22 of the gemstone 12 and the shoulder support 40 of the light-emitting shell 136 to retain the light-emitting shell 136 between the gemstone 12 and the head 216. The culet support 52 is located in spaced-apart relation to the gem retainer 150 and mates with the culet 26 of the gemstone 12 and retains the culet cover 142 of the light-emitting shell 136 between the gemstone 12 and the head 216 as suggested in FIG. 12. The prongs 254 extend between and interconnect the gem retainer 150 and the culet support 52.

The gem retainer 150 is configured to receive the shoulder support 40 of the light-emitting shell 136 therein to retain the light-emission system 114 in place relative to the head 216 as suggested in FIGS. 12 and 13. The gem retainer 150 includes the upper illusion plate 60, the lower plate 62, and the plurality of fold-up bars 164 as shown in FIG. 12.

The fold-up bars 164 are coupled to the lower plate 62 and extend radially inward toward the light-emitting shell 136 as shown in FIG. 12. The fold-up bars 164 engage the light-emitting shell 136 to support the light-emitting shell 136 and the gemstone 12. In the illustrative embodiment, the gem retainer 150 includes four fold-up bars 164.

The plurality of prongs 254 extend upwardly toward the gem retainer 150 as shown in FIG. 12. The plurality of prongs 254 forms a halo-support 284 as shown in FIGS. 12 and 13. The halo-support 284 extends around the gem retainer 150 to form a ring. The halo-support 284 couples to the lower plate 62 of the gem retainer 150. A plurality of gemstones may be coupled to the halo-support 284. The upper prong tip 70 of each prong 254 extends from the halo-support 284 and engages the gemstone 12. The first light source 176 illuminates the halo-support 284 and the plurality of gemstones.

The invention claimed is:

1. A light-emitting jewelry piece comprising a gemstone including a crown, a girdle, a pavilion, and a culet, the crown located in spaced-apart relation above the pavilion to locate the girdle therebetween, the pavilion located between the girdle and the culet a light-emission system including a light-emitting shell coupled to an exterior surface of the gemstone, including at least the pavilion and the girdle, configured to emit light over time in response to receiving and storing light to cause visible light to be emitted through the gemstone and viewed by a naked eye of a person when the light-emitting jewelry is in a dark environment, wherein the culet is mated with a portion of the light-emission system and the culet is about 13 percent larger in diameter than the culet of an American Standard or Tolkowsky Brilliant ideal cut gemstone to increase light transmission from the light-emission system to the gemstone, and wherein the light-emitting shell includes a body, a shoulder support extending radially around the body and away from the pavilion, and a culet cover extending downwardly away from the body; the culet cover and the shoulder support are configured to engage a head.

2. The light-emitting jewelry piece of claim 1, wherein the girdle thickness is 10 percent to 15 percent larger than the girdle of an American Standard or Tolkowsky Brilliant ideal cut diamond.

3. The light-emitting jewelry piece of claim 1, wherein a crown angle is defined between an outer surface of the crown and a top edge of the girdle and the crown angle is in a range of 40 degrees to 45 degrees.

4. The light-emitting jewelry piece of claim 1, wherein the crown angle is about 45 degrees.

5. The light-emitting jewelry piece of claim 1, wherein a pavilion angle is defined between an outer surface of the pavilion and a bottom edge of the girdle and the pavilion angle is in a range of 40 degrees to 50 degrees.

6. The light-emitting jewelry piece of claim 1, wherein the pavilion angle is about 41.5 degrees.

7. The light-emitting jewelry piece of claim 1, wherein a pavilion angle is defined between an outer surface of the pavilion and a bottom edge of the girdle and the pavilion angle is about 41.5 degrees, and a crown angle is defined between an outer surface of the crown and a top edge of the girdle, the crown angle is about 45 degrees.

8. The light-emitting jewelry piece of claim 1 further comprising the head that interconnects the gemstone to a mounting, the head includes a gem retainer, a culet support, and a plurality of prongs extending between and interconnecting the gem retainer and the culet support, and the gem retainer retains a portion of the light-emission system between the gemstone and the head.

9. The light-emitting jewelry piece of claim 8, wherein the gem retainer includes an upper illusion plate coupled to the crown and a lower plate coupled with the light-emitting shell and the upper illusion plate is spaced apart from the lower plate to form a female insert space that receives the shoulder support of the light emitting shell.

10. The light-emitting jewelry piece of claim 1, wherein the light-emitting shell is made from a photo-luminescent material.

11. The light-emitting jewelry piece of claim 1, wherein the body of the light-emitting shell has a thickness of about 0.5 millimeters.

* * * * *